US008282347B2

(12) United States Patent
Okazaki et al.

(10) Patent No.: US 8,282,347 B2
(45) Date of Patent: Oct. 9, 2012

(54) IMPELLER AND CENTRIFUGAL PUMP INCLUDING THE SAME

(75) Inventors: Yasuhide Okazaki, Hyogo (JP); Akihiro Ando, Hyogo (JP); Junya Enomoto, Hyogo (JP); Arata Funasaka, Hyogo (JP); Terumasa Okizoe, Hyogo (JP); Motonobu Tarui, Hyogo (JP); Yasuyuki Nishi, Hyogo (JP)

(73) Assignee: Shinmaywa Industries, Ltd. (JP)

( * ) Notice: Subject to any disclaimer, the term of this patent is extended or adjusted under 35 U.S.C. 154(b) by 852 days.

(21) Appl. No.: 12/331,711

(22) Filed: Dec. 10, 2008

(65) Prior Publication Data

US 2009/0311091 A1 Dec. 17, 2009

(30) Foreign Application Priority Data

Dec. 11, 2007 (JP) ..... 2007-320154

(51) Int. Cl.
*F04D 29/30* (2006.01)

(52) U.S. Cl. ..... 415/206; 415/71; 415/204

(58) Field of Classification Search ..... 415/115, 415/71–75, 203–204, 206; 416/177
See application file for complete search history.

(56) References Cited

U.S. PATENT DOCUMENTS

| | | | | |
|---|---|---|---|---|
| 1,754,992 | A | | 4/1930 | Fabrin |
| 1,854,992 | A | | 4/1930 | Fabrin |
| 1,849,127 | A | | 3/1932 | Wood |
| 2,272,469 | A | | 2/1942 | Lannert |
| 2,396,083 | A | | 3/1946 | Chase |
| 2,655,868 | A | | 10/1953 | Lindau et al. |
| 2,741,992 | A | | 4/1956 | Glazebrook |
| 2,853,019 | A | | 9/1958 | Thornton |
| 4,575,312 | A | | 3/1986 | Erikson |
| 4,614,478 | A | | 9/1986 | Sarvanne |
| 4,681,508 | A | | 7/1987 | Kim |
| 5,106,263 | A | * | 4/1992 | Irie ..... 415/206 |
| 5,348,444 | A | | 9/1994 | Mettzinger et al. |
| 6,837,684 | B2 | | 1/2005 | Ilves |
| 2005/0013688 | A1 | | 1/2005 | Nishi et al. |
| 2006/0127211 | A1 | | 6/2006 | Walker et al. |

FOREIGN PATENT DOCUMENTS

| | | | |
|---|---|---|---|
| JP | S49-13522 | B | 4/1974 |
| JP | S53-127303 | U | 10/1978 |
| JP | S55-1946 | U | 1/1980 |
| JP | S60-261993 | A | 12/1985 |
| JP | 2006-291917 | A | 10/2006 |
| JP | 2006-527804 | A | 12/2006 |

* cited by examiner

*Primary Examiner* — H. Jey Tsai
(74) *Attorney, Agent, or Firm* — Studebaker & Brackett PC; Donald R. Studebaker

(57) ABSTRACT

An example impeller includes: an impeller body in which an internal channel is formed, the internal channel extending inside the impeller body in a direction of a rotation axis spirally about the rotation axis to connect an inlet and an outlet; and at least one centrifugal vane provided in the impeller body. The internal channel including the inlet and the outlet has a predetermined passage diameter. An external channel is formed so as to continue to the outlet and go around the circumferential surface of the impeller body, the external channel being defined by the centrifugal vane and being recessed inward in the radial direction from the circumferential surface of the impeller body. At least a part in a flow direction of the external channel has a channel width in the direction of the rotation axis smaller than the width of the outlet.

4 Claims, 10 Drawing Sheets

IMPELLER AND CENTRIFUGAL PUMP INCLUDING THE SAME

BACKGROUND

The present disclosure relates to an impeller for a pump and a pump including it.

A centrifugal pump is used as a pump for conveying sewage and the like in some case. The centrifugal pump includes an impeller and a casing as essential components. The applicants of the present application developed a non-clogging type impeller as an impeller which involves less choke even upon suction of sewage including solid matter, such as contaminants, and disclosed it in US2005/013688.

SUMMARY

An example impeller includes: an impeller body in which an internal channel is formed, the internal channel extending inside the impeller body in a direction of a rotation axis spirally about the rotation axis to connect an inlet open in an end surface of the impeller body and an outlet open in a circumferential surface thereof; and at least one centrifugal vane provided in the impeller body. The internal channel including the inlet and the outlet has a predetermined passage diameter. An external channel is formed so as to continue to the outlet and go around the circumferential surface of the impeller body. The external channel being defined by the centrifugal vane and being recessed inward in the radial direction from the circumferential surface of the impeller body. At least a part in a flow direction of the external channel has a channel width in the direction of the rotation axis smaller than the width of the outlet.

DETAILED DESCRIPTION

Figure 1:
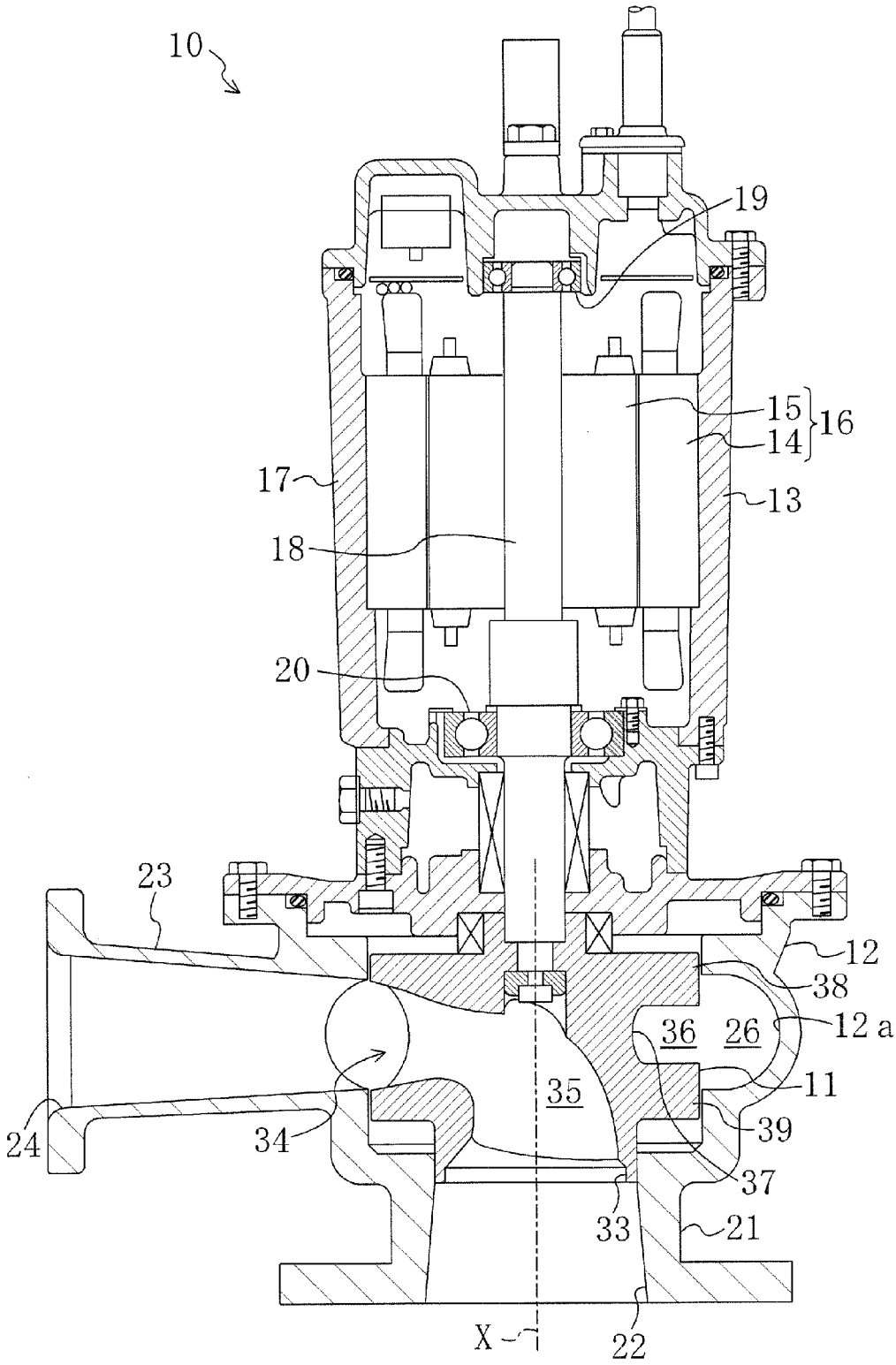
FIG. 1 is a vertical sectional view of an example submersible pump.

Centrifugal pumps for sewage may be required to have pump characteristics exhibiting high head pumping in small flow rate ranges.

The applicants found that conventional centrifugal pumps encountered difficulty in obtaining such pump characteristics exhibiting high head pumping in small flow rate ranges. Because, in the case where an impeller used in a centrifugal pump includes a first channel formed inside thereof and a second channel formed outside thereof, the diameter of the first channel and the channel width of the second channel are almost equal to each other.

In detail, the impeller included in a sewage pump is so designed that the passage diameter is not changed in the course of its channel. The passage diameter in this description is defined as the maximum diameter of a ball capable of passing through the channels. No change in the passage diameter means that the diameter of the first channel and the channel width of the second channel are almost equal to each other.

In order to allow solid matter to pass therethrough favorably, the passage diameter of the impeller is set comparatively large. In association, the channel width of the second channel formed outside the impeller becomes comparatively large to increase the channel area of the second channel. Such a large channel area increases the discharge flow rate of the centrifugal pump to disable high head pumping.

In other words, it can be said that the conventional centrifugal pump, which has a large channel area of the second channel has a head curve (a curve indicating the relationship between the discharge amount and the total head) of which the inclination is gentle. In order to obtain a desired head in a pump having pump characteristics of which the head curve remains gentle, the pump capacity must be set large more than necessary for increasing the pump power. This invites energy consumption in vain.

As another measure for increasing the pump head, the diameter of the impeller may be increased. However, the applicants noticed a problem that this measure increases the discharge flow rate, which accompanies an increase in required power, to exceed the rated power. Accordingly, employment of the measure of merely increasing the diameter of the impeller is unfavorable.

A pump including an example impeller disclosed herein can realize high head pumping in small flow rate ranges with the passage diameter set large.

In detail, the applicants found that where only the diameter of an internal channel formed inside the impeller is set comparatively large so as to be equal to a predetermined passage diameter, any solid matter can be discharged even if the channel width of an external channel formed outside the impeller is not so large as much as the passage diameter. In view of this, the applicants reduced the discharge flow rate of the pump in such a manner that the channel area of the external channel is reduced by reducing the channel width of the external channel to be narrower than the passage diameter. Whereby, the pump including the exampled impeller can perform high head pumping.

The example impeller includes: an impeller body in which an internal channel is formed, the internal channel extending inside the impeller body in a direction of a rotation axis spirally about the rotation axis to connect an inlet open in an end surface of the impeller body and an outlet open in a circumferential surface thereof; and at least one centrifugal vane provided in the impeller body. The internal channel including the inlet and the outlet has a predetermined passage diameter. An external channel is formed so as to continue to the outlet and go around the circumferential surface of the impeller body. The external channel being defined by the centrifugal vane and being recessed inward in the radial direction from the circumferential surface of the impeller body. At least a part in a flow direction of the external channel has a channel width in the direction of the rotation axis smaller than the width of the outlet.

The internal channel of the example impeller has the predetermined passage diameter at both the inlet and the outlet thereof. Accordingly, almost all solid matter included in sewage can be discharged outside from the discharge port of the pump through the internal channel.

In contrast, water (sewage) passes through the external channel after passing through the internal channel. At that time, the water pressure is increased by the centrifugal vane. Then, the water is discharged outside from the discharge port of the pump.

Herein, at at least a part of the external channel, the channel width in the direction of the rotation axis is set smaller than the width of the outlet, that is, the passage diameter. This reduces the sectional area of the external channel to reduce the discharge flow rate. As a result, the pump including this impeller can have a sharply inclined head curve. Accordingly, the outer diameter of the impeller body can be increased with the necessary power remaining equivalent to that of the conventional one, with a result that the pump bead can be increased. In other words, the pump including the example impeller is advantageous in realizing high head pumping in small flow rate ranges.

The channel width of the external channel may be a constant width smaller than the width of the outlet over an entire section from an upstream end to a downstream end thereof.

With this arrangement, the discharge flow rate of the pump is further throttled to obtain a further sharply inclined head curve. Hence, it can be advantageous in contemplating further high head pumping.

In the example impeller, the external channel may have a reduced portion in which the channel width in the direction of the rotation axis reduces gradually as it goes downstream in a flow direction.

In the above arrangement, the external channel includes the channel width reduced portion in which the channel width gradually reduces downstream to reduce the discharge flow rate of the pump. Accordingly, the pump including this impeller can have a sharply inclined head curve, which can be advantageous in achieving high head pumping in small flow rate ranges, as well as in the above case.

The channel width of the example impeller is not changed suddenly when viewing the external channel in the flow direction. Accordingly, it can suppress deteriorating of the pump efficiency due to vortex generation.

The channel width of the external channel may reduce gradually in the entire section from an upstream end to a downstream end thereof.

With the arrangement, the discharge flow rate of the pump can be further throttled to implement further high head pumping in small flow rate ranges and to suppress deteriorating of the pump efficiency. In other words, this configuration can achieve high head pumping with no deteriorating of the pump efficiency involved.

Respective side parts in the direction of the rotation axis of the impeller body which interpose the external channel may form flange parts protruding radially outward from the entire periphery thereof, and an edge part of at least one of the flange parts is cut to increase the channel width of the external channel in the direction of the rotation axis gently from inside toward outside in the radial direction.

With the above arrangement, the pump loss can be reduced. The reason thereof is as follows. Where the width of the external channel of the impeller body is set narrower than the width of the outlet of the impeller body, while the width of a volute chamber of a casing accommodating the impeller body is set equal to the width of the outlet of the impeller body, the width of the channel suddenly increases between the external channel of the impeller body and the volute chamber of the casing when viewing the impeller body in vertical section (when viewing it in section orthogonal to the flowing direction). This sudden increase in the channel width generates mixing loss.

In contrast, the width of the external channel in the direction of the rotation axis is increased gently by cutting the edge part of at least one of the flange parts, such a sudden increase in the channel width is removed. This can avoid mixing loss.

Respective side parts in the direction of the rotation axis of the impeller body which interpose the external channel may form flange parts with spaces left from an inner peripheral wall of a casing accommodating the impeller body in a pump, and a trench may be formed in at least one of the flange parts so as to be recessed inward in the radial direction from and go around the circumferential surface of the at least one flange part.

Reduction in the channel width of the external channel accompanies an increase in thickness of the flange parts. In the pump, the contact area between the circumferential surface of the flange part and the inner peripheral wall of the casing increases to invite an increase in friction resistance between the circumferential surface of the flange part and the inner peripheral wall of the casing. Herein, though the circumferential surface of the flange part and the inner peripheral wall of the casing are not actually in contact with each other, an area of a part where the circumferential surface of a flange part and the inner peripheral wall of the casing face each other with a small space left is called a contact area for convenience' sake.

In contrast, the trench formed in the at least one flange part reduces the contact area between the circumferential surface of the at least one flange part and the inner peripheral wall of the casing to enable suppression of an increase in the friction resistance. This can be advantageous in increasing the pump efficiency.

Further, trench formation can obtain the labyrinth effect in the small space between the circumferential surface of the at least one flange part and the inner peripheral wall of the casing to prevent leakage through the small space. In order to suppress the leakage, it is preferable to form a trench in a flange part which corresponds to the inlet (the suction side of the pump) of the internal channel of the impeller in which pressure difference between the respective sides interposing the flange part is large.

An example centrifugal pump includes: the above impeller; a casing including a suction port, a volute chamber, and a discharge port, and accommodating the impeller thereinside; and a motor section driving and rotating the impeller, wherein the outlet has a passage diameter equal to or larger than that of the internal channel of the impeller.

The width of the external channel of the impeller is set narrower than the width of the outlet of the internal channel, while the passage diameter of the discharge port of the casing is set larger than the passage diameter of the internal channel. Accordingly, almost all solid matter having passed through the internal channel of the impeller and reaching the outlet are discharged to the discharge port from the impeller when the outlet agrees with the discharge port (in other words, when the ports face each other) as the impeller rotates, thereby being discharged outside the pump through the discharge port.

Water (sewage) is discharged outward in the radial direction of the impeller by the centrifugal vane of the impeller, and is then discharged outside the pump from the discharge port through the volute chamber of the casing.

EXAMPLE IMPELLER

Example impellers and centrifugal pumps will be described below with reference to the accompanying drawings. It is noted that the following description presents mere essential examples, and is not intended to limit applicable subjects and uses.

FIG. 1 shows an example pump. The pump is a submersible pump 10 used as a pump for transporting and discharging sewage including solid matter in a sewage system. The submersible pump 10 is a centrifugal pump including an impeller 11, a casing 12 covering the impeller 11, and a hermetic submerged motor 13 rotating the impeller 11. The impeller 11 and the casing 12 may be made of metal or synthetic resin.

Inside the impeller 11 an internal channel 35 is formed. The internal channel 35 connects an inlet 33 and an outlet 34. In the circumferential surface of the impeller 11, an external channel 36 is formed. The external channel 36 continues to the internal channel 35 at the outlet 34.

The external channel 36 has at least a section of which the channel width is smaller than the width of the outlet 34. The channel width of the external channel 36 may be narrowed gradually as it goes downstream. This is effective in realizing high head pumping in small flow rate ranges with the passage diameter of the submersible pump 10 set large.

The example pimp 10 will be described further in detail.

The submerged motor 13 includes a motor 16 including a stator 14 and a rotor 15, and a motor casing 17 covering the motor 16. At the central part of the rotor 15, a drive shaft 18 is provided which extends vertically. The drive shaft 18 is supported rotatably by an upper bearing 19 and a lower bearing 20. The lower part of the drive shaft 18 is connected to the impeller 11 for transmitting the rotational drive power of the submerged motor 13 to the impeller 11.

The casing 12 includes inside thereof a volute chamber 26 surrounding the impeller 11. The volute chamber 26 is defined by a side wall 12*a* of the casing which is curved in a semi-circular shape in vertical section. The width in the axial direction of the volute chamber 26 (width in the vertical direction thereof in FIG. 1) is substantially equal to the width of the outlet 34 in the impeller 11, which will be described later.

The lower end part of the casing 12 forms integrally a suction portion 21 protruding downward. The suction portion 21 has a suction port 22 open downward. The suction port 22 communicates with the inlet 33 in the impeller 11, which will be described later.

The side part of the casing 12 forms integrally a discharge portion 23 protruding sideways. The discharge portion 23 communicates with the volute chamber 26, and has a discharge port 24 open sideways. The discharge portion 23 increases its channel diameter as it goes downward in the present example, but the channel diameter thereof is not limited thereto, and may be set constant. The diameter of the inlet of the discharge portion 23 (the connection port to the volute chamber 26) is substantially equal to the diameter of the outlet 34 of the impeller 11. In other words, the passage diameter of the discharge portion 23 is equal to the passage diameter of the internal channel 35 of the impeller 11. The passage diameter of the discharge portion 23 may be equal to or larger than the passage diameter of the internal channel 35.

Figure 2:
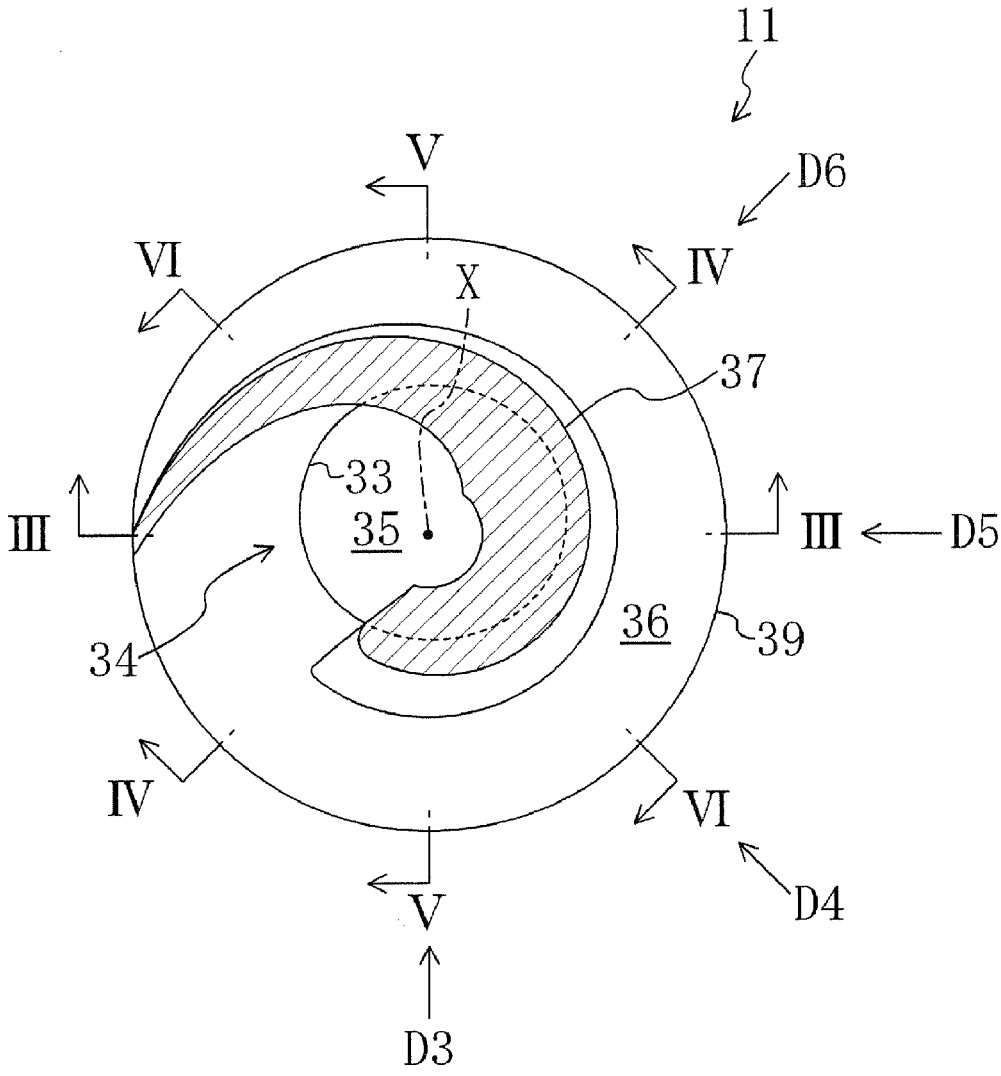
FIG. 2 is a transverse sectional view of an example impeller (a sectional view taken along the line II-II in FIG. 3A).

As shown in FIG. 2 to FIG. 6, the impeller 11 is substantially in a cylindrical shape including an upper end surface, a lower end surface, and a circumferential surface therebetween. The inlet 33 open downward is formed in the lower end surface of the impeller 11, while the outlet 34 open sideways is formed in the circumferential surface thereof. Inside the impeller 11, the internal channel 35 is formed which extends in the direction of the rotation axis spirally about the rotation axis X of the impeller 11. The inlet 33 and the outlet 34 are connected to each other through the internal channel 35. The inlet 33 and the outlet 34 of the internal channel 35 serve as an inlet 33 and outlet 34 of the impeller 11, respectively. As shown in FIG. 2, the outlet 34 opens along the direction in which the internal channel 35 extends. The internal channel 35 including the inlet 33 and the outlet 34 is so composed to have a predetermined passage diameter. The passage diameter of the internal channel 35 is set so as to correspond to the diameter of a pipe located upstream of the submersible pump 10 in a sewage system. In this example, the diameter of the internal channel 35 is comparatively large so as to have a comparatively large passage diameter thereof.

In the circumferential surface of the impeller 11, the external channel 36 recessed inward in the radial direction of the impeller 11 is formed. The external channel 36 does not extend in the direction of the rotation axis X, and the center of its channel is always located on a plane of the impeller 11 which is orthogonal to the rotation axis X. The external channel 36 is connected to the internal channel 35 at the outlet 34, as shown in FIG. 2. The external channel 36 extends over a length equal to or longer than one half of the circumference of the impeller. Specifically, the downstream end of the external channel 36 extends to the vicinity of the outlet 34. The length of the external channel 36 is preferably equal to or longer than one half of the circumference of the impeller and not exceeding the circumference thereof, but is not limited specifically.

The external channel 36 is defined by a vane 37. This vane 37 is a vane of generally-called radial flow type (a centrifugal vane). The centrifugal vane 37 increases the pressure of water in the external channel 36, and discharges the water to the circumferential side (outward in the radial direction). The vane 37 has a leading edge in the vicinity of the outlet 34, and extends over a length almost equal to the circumference of the impeller 11. Accordingly, the tailing edge of the vane 37 is located in the vicinity of the outlet 34. In the example impeller 11, the single vane 37 is provided, but two or more vanes 37 may be provide.

Figure 3A:
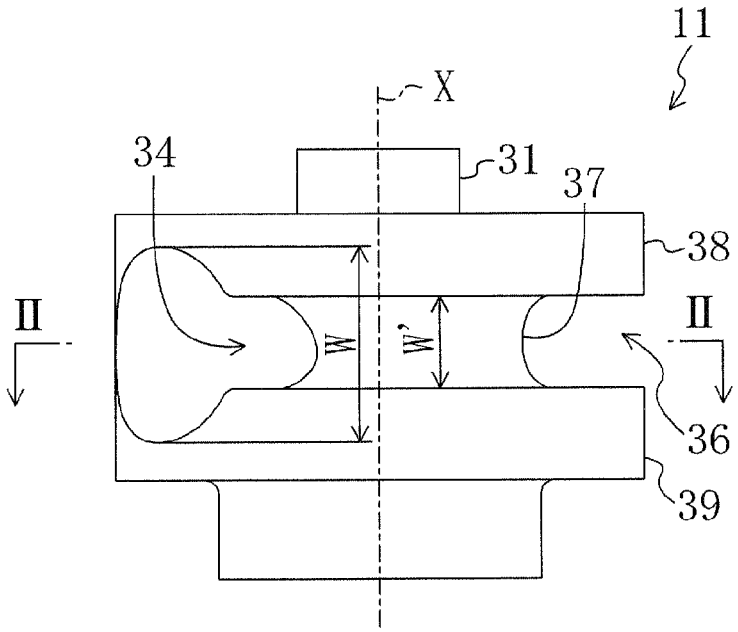
FIG. 3A is a view diagram as viewed from D3 in FIG. 2.
Figure 3B:
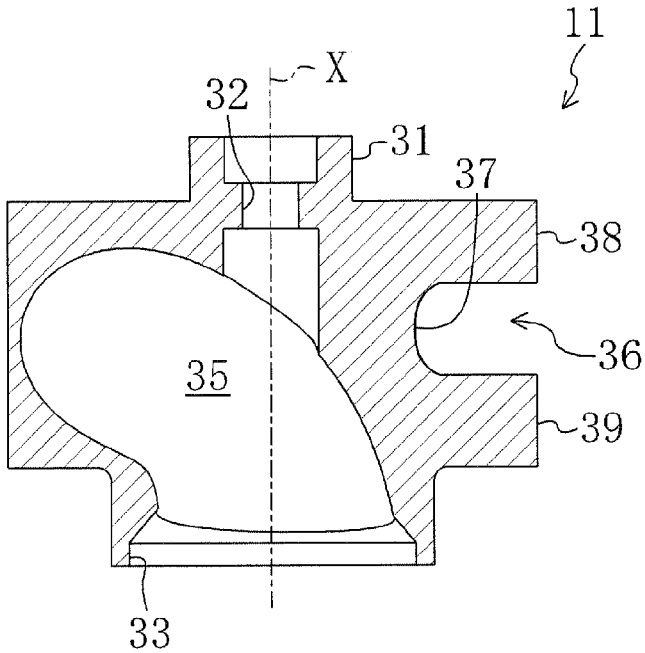
FIG. 3B is a sectional view taken along the line III-III in FIG. 2.
Figure 4A:
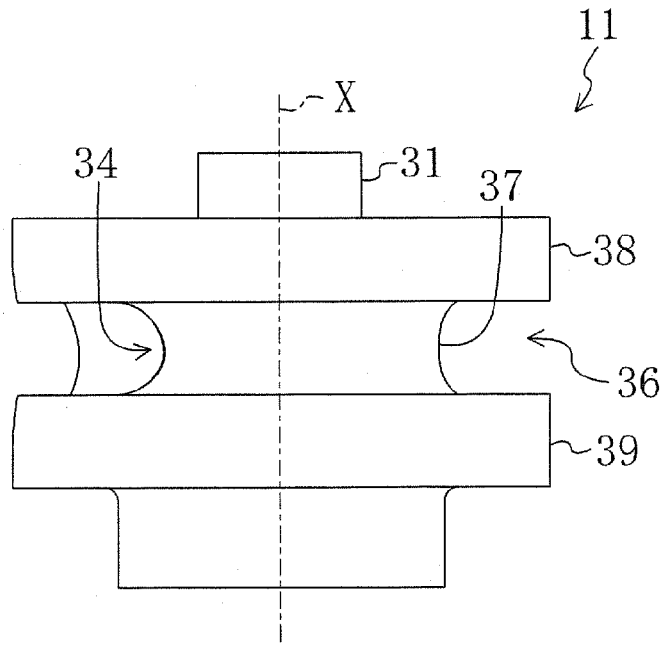
FIG. 4A is a view diagram as viewed from D4 direction in FIG. 2.
Figure 4B:
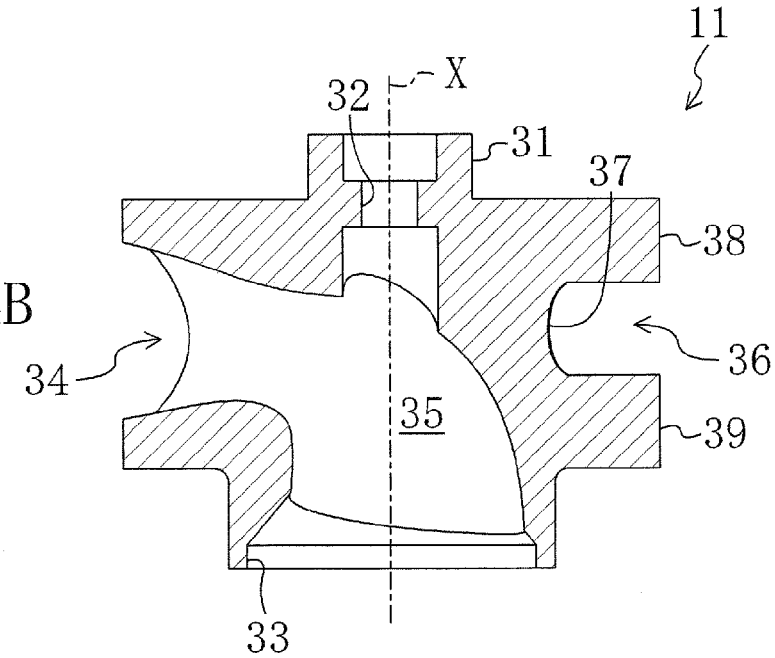
FIG. 4B is a sectional view taken along the line IV-IV in FIG. 2.
Figure 5A:
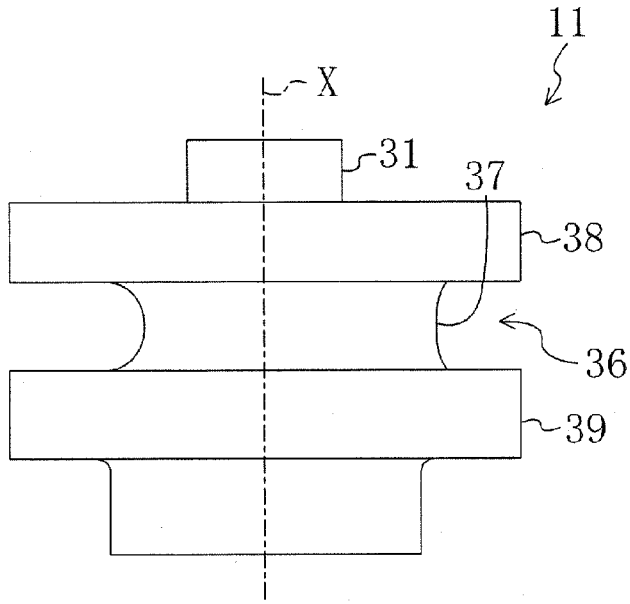
FIG. 5A is a view diagram as viewed from D5 direction in FIG. 2.
Figure 5B:
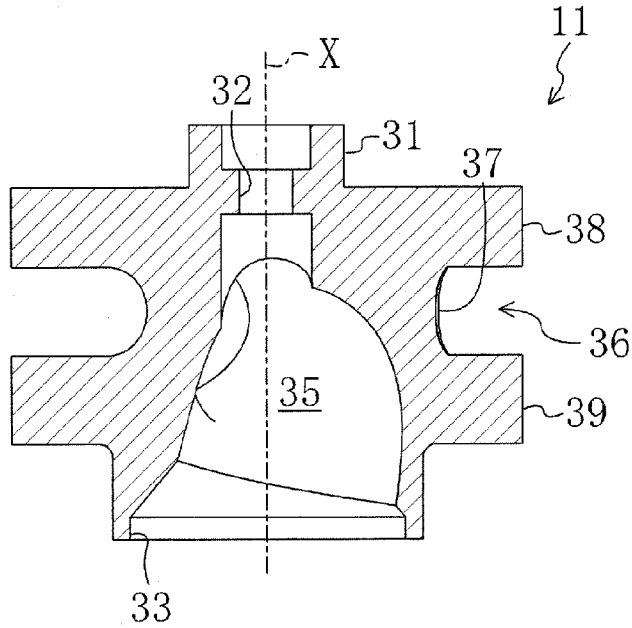
FIG. 5B is a sectional view taken along the line V-V in FIG. 2.
Figure 6A:
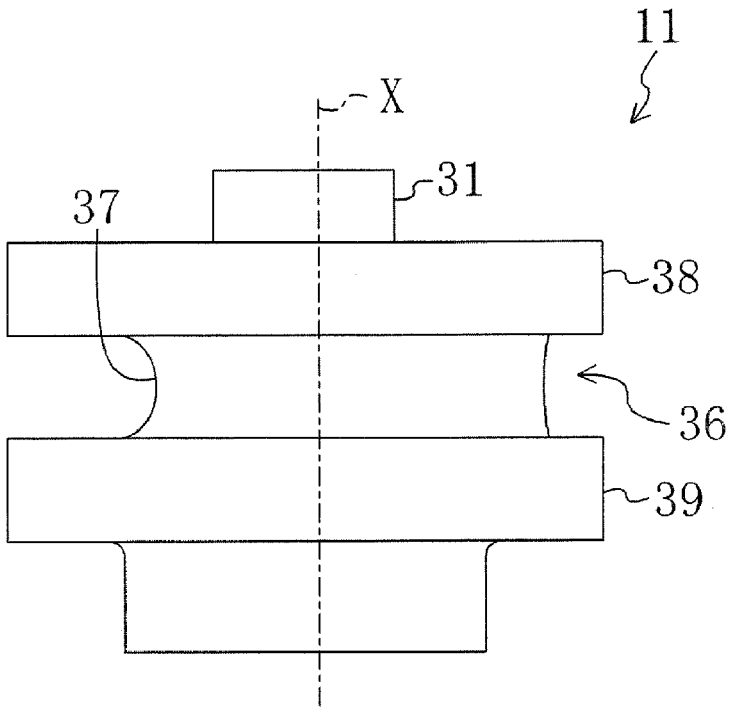
FIG. 6A is a view diagram as viewed from D6 direction in FIG. 2.
Figure 6B:
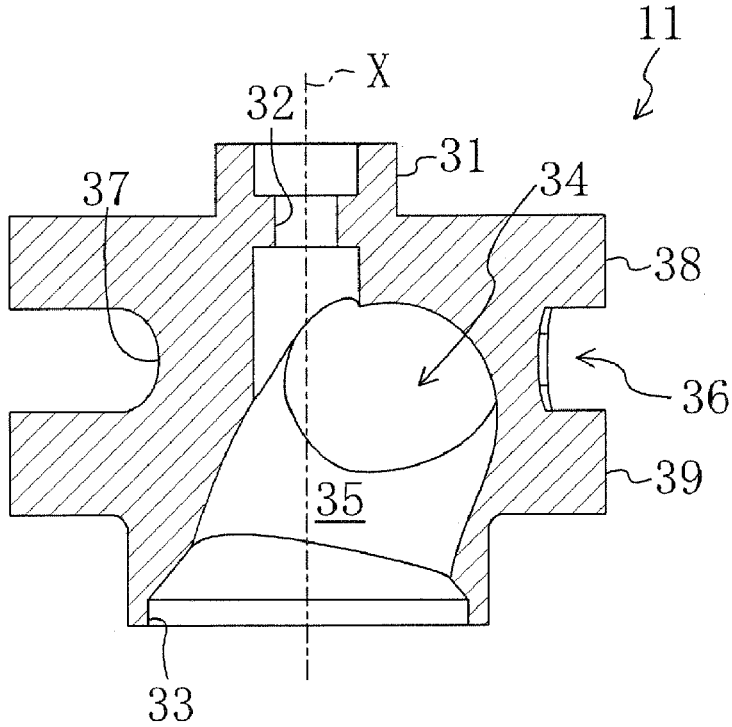
FIG. 6B is a sectional view taken along the line VI-VI in FIG. 2.

The channel width W' in the direction of the rotation axis X of the external channel 36 is smaller than the width W of the outlet 34 ($W'<W$), as shown in FIG. 3 and the like. Accordingly, the channel is reduced suddenly at a part between the outlet 34 and the external channel 36, as shown in FIG. 3A. The channel width of the external channel 36 is a reduced width constant from the leading edge of the centrifugal vane 37 corresponding to the upstream end of the external channel 36 to the trailing edge of the centrifugal vane 37 corresponding to the downstream end of the external channel 36.

In a part of the impeller 11 which is upper than the external channel 36, a first flange part 38 is formed which protrudes radially from the entire circumference thereof. Similarly, in a part of the impeller 11 which is lower than the external channel 36, a second flange part 39 is formed which protrudes radially from the entire circumference thereof. The second flange part 39 partitions transversely the impeller 11 into a lower part in which the inlet 33 is formed and an upper part in which the outlet 34 is formed. Accordingly, the impeller 11 is a closed type impeller of which the inlet 33 and the outlet 34 are partitioned by the second flange part 39.

A boss part 31 is formed at the central part in the upper end surface of the impeller 11. The boss part 31 has a mounting hole 32 for receiving the tip end part of the drive shaft 18.

The submersible pump 10 sucks and discharges sewage in the following manner. Namely, the submerged motor 13 rotates the impeller 11 to make sewage to be sucked upward from the inlet 33 in the lower part of the impeller 11. The sewage sucked in the impeller 11 passes through the internal channel 35 to reach the external channel 36 through the outlet 34. Thereafter, the sewage is pushed by the rotating centrifugal vane 37 to be discharged outward in the radial direction of the impeller 11. The casing 12 covering the impeller 11 receives the thus discharged sewage, allows it to flow into the volute chamber 26, and discharges then the sewage outside the pump through the discharge port 24.

Since the passage diameter of the internal channel 35 is set comparatively large, as described above, if the impeller 11 sucks solid matter from the inlet 33, the sucked solid matter reaches the outlet 34 through the internal channel 35. In contrast to the internal channel 35, the external channel 36 has the reduced channel width, and therefore, some solid matter may not pass through the external channel 36. However, since the diameter of the discharge portion 23 of the casing 12 is set equal to or larger than the passage diameter, the solid matter can be discharged from the impeller to the discharge portion 23 upon agreement of the outlet 34 of the impeller 11 with the discharge portion 23 of the casing 12 by the rotation of the impeller 11, namely, when the outlet 34 of the impeller 11 and the discharge portion 23 of the casing 12 face each other. The thus discharged solid matter is discharged outside the submersible pump 10 together with the sewage through the discharge portion 23.

The external channel 36, which has the comparatively small channel width, has a small cross-sectional area, to reduce the discharge flow rate of the submersible pump 10. This enables the submersible pimp 10 to perform high head pumping in small flow rate ranges. In other words, less amount of pump power than that required in a conventional centrifugal pump is needed for obtain the same head, with a result that effective operation of the submersible pump 10 satisfying required specifications can be achieved. This means possibility of suppressing the energy consumption.

In reverse, the outer diameter of the impeller 11 can be increased with the pump power unchanged. This can be advantageous in implementing high head pumping in small flow rate ranges.

Figure 7A:
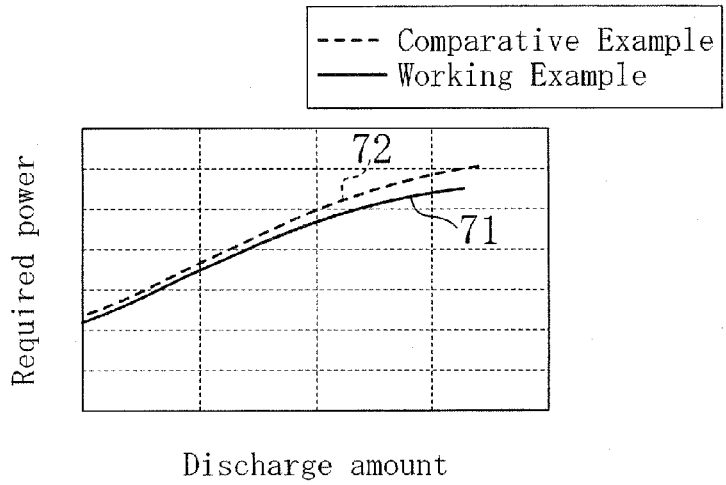
FIG. 7A and FIG. 7B are examples of performance curves of submersible pumps.
Figure 7B:
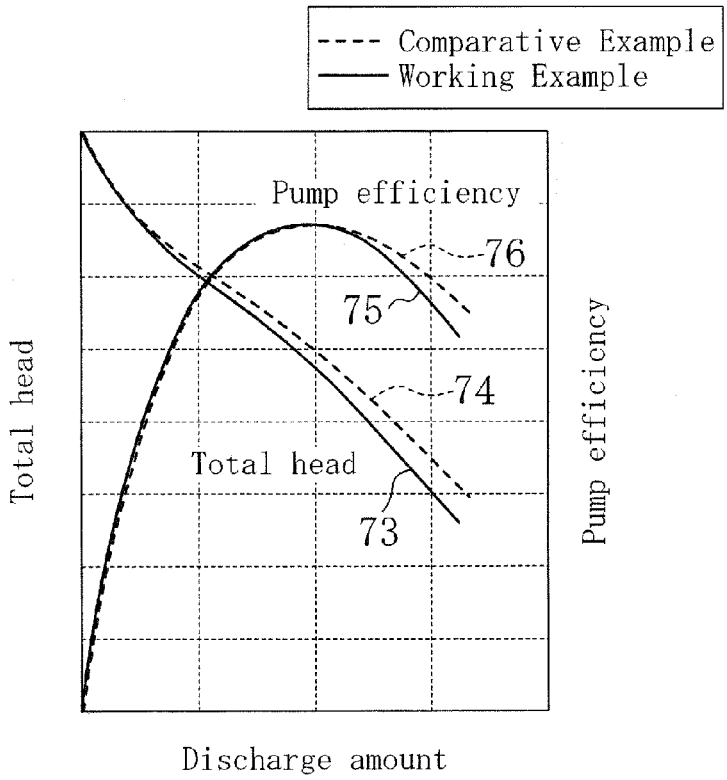

A working example that was concretely carried out will be described next. First, as the working example, an impeller 11 was prepared which includes the external channel 36 of which the channel width is reduced, as shown in FIG. 2 to FIG. 6. This channel width was reduced to 75% of the width of the outlet 34 (W'/W=0.75). In contrast, though not shown, an impeller was prepared as a comparative example which includes an external channel of which the channel width is equal to the width of the outlet (W'/W=1). Then, comparison was made therebetween in characteristics of the centrifugal pumps. Namely, each comparison was made between the required powers 71, 72, between the total heads 73, 74, and between the pump efficiencies 75, 76 with respect to the discharge amounts of the examples, as shown in FIG. 7. As shown in FIG. 7B, the head curve 73 of the centrifugal pump including the working example impeller is has a more sharp inclination than that 74 of the comparative example centrifugal pump. Comparison between the efficiency curve 75 of the working example centrifugal pimp and that 76 of the comparative example centrifugal pump reveals that while the working example pump has a maximum efficient point in a flow rate range slightly smaller than that of the comparative example centrifugal pump, the maximum efficiency thereof is approximately equal to that of the comparative example. Referring to the power curve 71 of the working example centrifugal pump, the required power is lower than that in the power curve 72 of the comparative example centrifugal pump, as shown in FIG. 7A. Accordingly, the working example pump may achieve high head pumping in small flow rate ranges.

Herein, an example is presented as the working example in which the channel width of the external channel 36 is reduced to 75% of the passage diameter. However. the ratio between the channel width of the external channel 36 and the passage diameter is not limited thereto. Further reduction in the channel width of the external channel 36 makes the inclination of the head curve more sharp, and changes the characteristics, such as the pump efficiency and the required power. Hence, the channel width of the external channel 36 may be set according to desired pump characteristics.

Although the channel width of the external channel 36 herein is reduced to be constant over the entire section from the leading edge to the trailing edge of the centrifugal vane 37 (the entire section from the upstream end to the downstream end of the external channel 36), only a part of the section ranging from the leading edge to the trailing edge of the centrifugal vane 37 may be reduced to have a constant width. For example, when the channel width may be reduced to be constant from a middle point between the leading edge and the trailing edge of the centrifugal vane 37 to the trailing edge thereof so that a part suddenly reduced in diameter is not formed at the joint part between the outlet 34 of the impeller 11 and the external channel 36. In this case, the middle point is not limited specifically. Alternatively, the channel width may be reduced to be constant from the leading edge to a middle point of the centrifugal vane 37, or only an intermediate part between the leading edge and the trailing edge of the centrifugal vane 37 may be reduced to have a constant width.

Figure 8A:
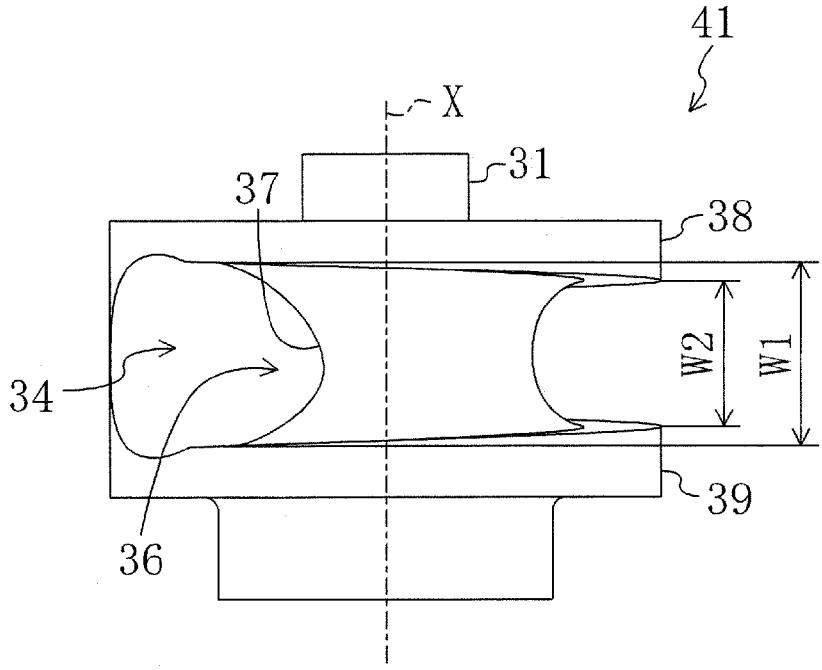
FIG. 8A, FIG. 8B, FIG. 9A, and FIG. 9B are illustrations of a modified example impeller.
Figure 8B:
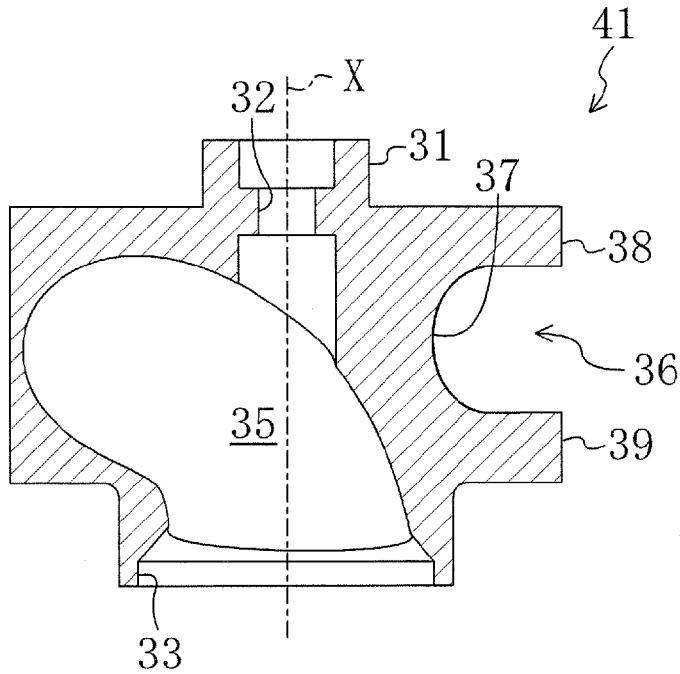
Figure 9A:
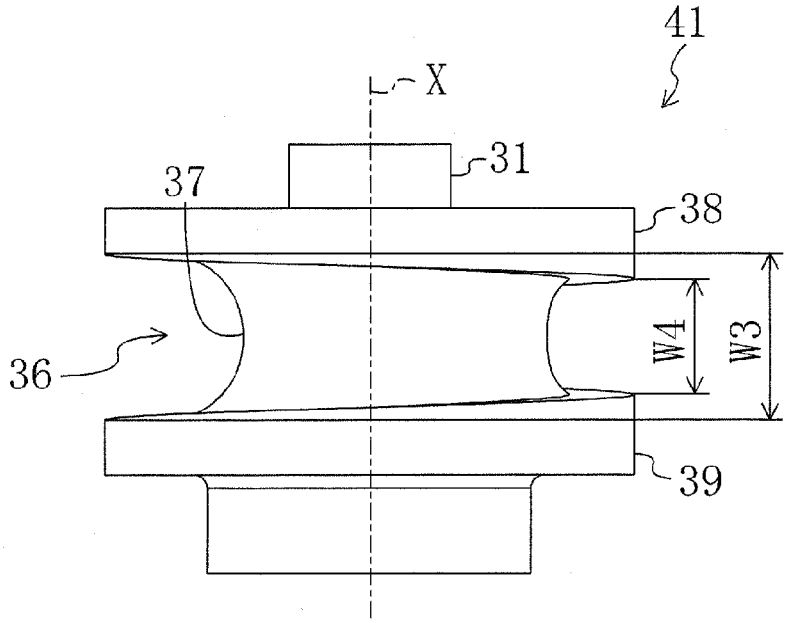
Figure 9B:
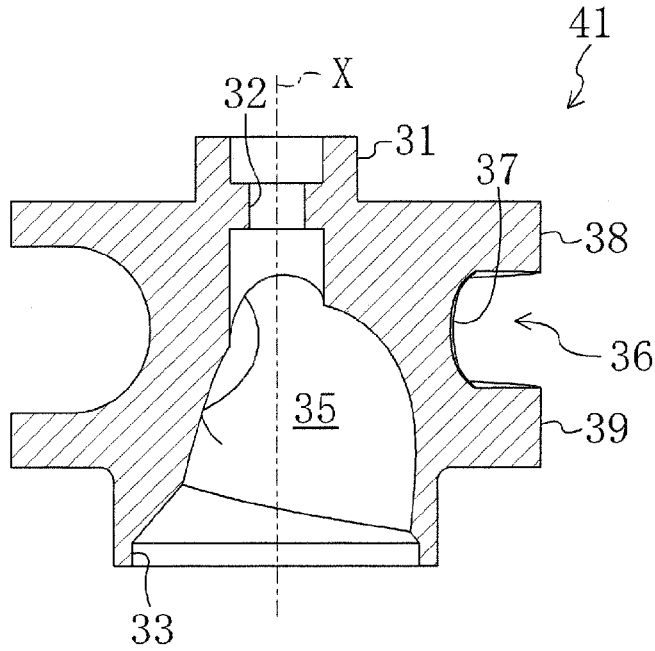

FIG. 8 and FIG. 9 show an impeller 41 as a modified example. FIG. 8 corresponds to FIG. 3, while FIG. 9 corresponds to FIG. 5. The impeller 41 has an external channel 36 of which the channel width gradually reduces from the upstream side toward the downstream side.

Specifically, the external channel 36 of the impeller 41 is reduced in the channel width at a predetermined rate from the upstream end (the joint point to the outlet 34) of the external channel 36 corresponding to the leading edge of the centrifugal vane 37 to the downstream end of the external channel 36 corresponding to the trailing edge of the centrifugal vane 37 (see W1 to W4 in FIG. 8A and FIG. 9A, wherein W1>W3>W2>W4). In this impeller 41, the same reference numerals are assigned to the same components as those of the impeller 11 shown in FIG. 3 and the like for appropriately omitting description thereof.

In the impeller 41, the channel width of the external channel 36 is throttle to reduce the discharge amount of the submersible pump 10. This may be advantageous in implementing high heat pumping in small flow rate ranges, similarly to the above case.

With gradual reduction in the channel width of the external channel 36 of the impeller 41, no sadden reduction in the channel width is observed when viewed along the flow direction from the upstream side to the downstream side of the external channel 36. Accordingly, the vortex loss accompanied by such sudden reduction therein is not caused to exhibit further improved pump efficiency.

In the impeller 41, the reduction rate of the channel width of the external channel 36 may be set appropriately with the pump characteristics taken into consideration. The part where the channel width is reduced may be set in a part of the section ranging from the leading edge to the trailing edge of the centrifugal vane 37. For example, the channel width of the external channel 36 may be set constant to be equal to the width of the outlet 34 from the leading edge to a middle point of the centrifugal vane 37 while being reduced gradually in a part from the middle point to the trailing edge thereof. Alternatively, the channel width thereof may be reduced gradually from the leading edge to a middle point of the centrifugal vane 37 while being set constant at the final reduced width in a part from the middle point to the trailing edge thereof. Alternatively, the external channel 36 may be formed in such a fashion that: the channel width thereof is set constant from the leading edge to a middle point of the centrifugal vane 37; is reduced gradually in a part between the middle point to another middle point before the trailing edge thereof, and is set constant at the final reduced width in a part from the other middle point to the trailing edge thereof.

Figure 10:
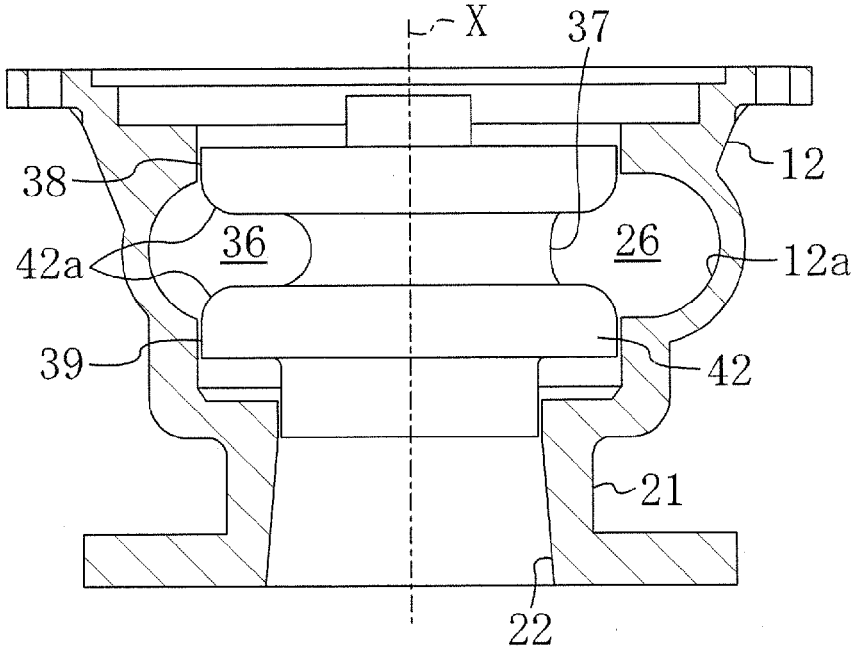
FIG. 10 is a sectional view of a casing of a modified example centrifugal pump.

FIG. 10 shows only a part corresponding to the casing 12 accommodating an impeller 42 of a centrifugal pump as a modified example centrifugal pump. The submerged motor 13 may have the same construction as that shown in FIG. 1, and therefore, description thereof is omitted here.

In this modified example centrifugal pump, the flange parts 38, 39 of the impeller 42 are devised for improving the pump efficiency.

Specifically, as shown in FIG. 10, the impeller 42 has an external channel 36 of which the channel width is set smaller than the width of the outlet 34, so that the channel width of the external flow pat 36 is smaller than the width of the volute chamber 26 of the casing 12. The point is the same as that in the impeller 11 shown in FIG. 3 and the like.

In the impeller 42, an arc 42*a* is formed at the corner of the first flange part 38 in the external channel 36. Similarly, an arc 42*a* is formed at the corner of the second flange part 39 in the external channel 36. Whereby, the channel width of the external channel 36 in the direction of the rotation axis X (corresponding to the vertical direction in FIG. 10) increases gently from the inside toward the outside in the radiation direction when viewed in section orthogonal to the flow direction of the external channel 36.

As described above, when the channel width of the external flow width 36 is set smaller than the width of the volute chamber 26 of the casing 12, the channel width suddenly increases in the direction of the rotation axis X at a part between the external channel 36 and the volute chamber 26 in general when viewed in section orthogonal to the flow direction of the external channel 36 (see FIG. 1 for reference).

In contrast, in the impeller 42 shown in FIG. 10, the arcs 42*a* are formed by cutting the edge part of each of the first and second flange parts 38, 39 into an arc shape, so that the channel width of the external channel 36 in the direction of the rotation axis X increases gently from the inside to the outside in the radial direction. Accordingly, the vortex loss accompanied by a sadden increase in the channel width may not be caused. This may be advantageous in implementing improvement of the pump efficiency.

Each edge part of the first and second flange parts 38, 39 may be cut aslant rather than be cut into an arc shape as shown in FIG. 10.

The channel width of the external channel 36 may be reduced gradually from the upstream side to the downstream side, as in the impeller 41 shown in FIG. 8 and the like, rather than sets at a constant channel width from the upstream side to the downstream side.

Figure 11:
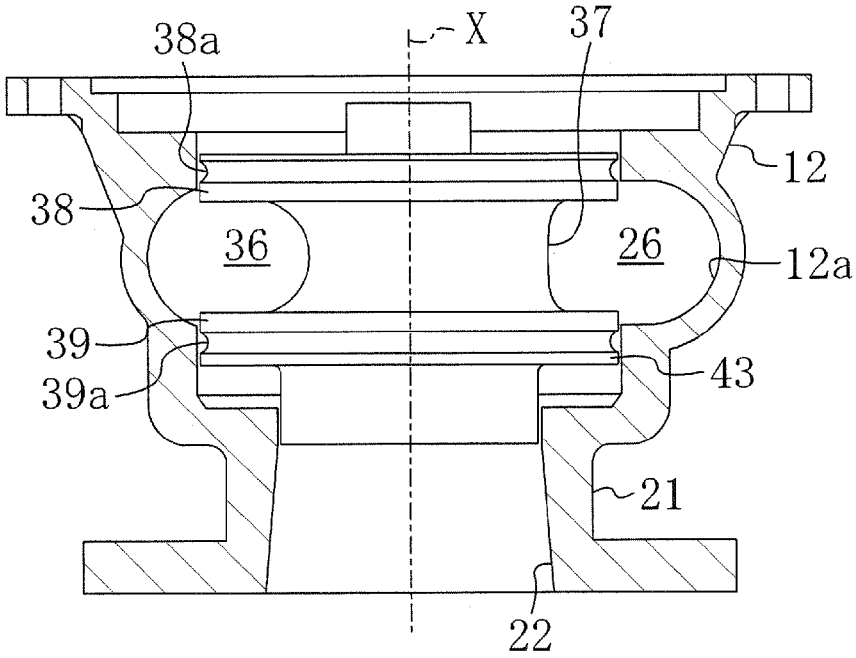
FIG. 11 is a sectional view of a casing of another modified example centrifugal pump.

FIG. 11 shows only a part of an example centrifugal pump different from that shown in FIG. 10. The submerged motor 13 may have the same construction as that in FIG. 1, and therefore, description thereof is omitted here.

This centrifugal pump contemplates reduction in pump loss by devising the shape of the flange parts 38, 39 of an impeller 43.

Specifically, as shown in FIG. 11, the impeller 43 has an external channel 36 of which the channel width is smaller than the width of the outlet 34. This point is the same as that of the impeller 11 shown in FIG. 3 and the like. Reduction in the channel width increases the width (thickness) of the first and second flange parts 38, 39 relatively. Accordingly, the area of a part where the first and second flange parts 38, 39 face the inner peripheral wall of the casing 12 with small spaces left is larger than the case where the channel width is not reduced. Hereinafter, this area is referred to as a contact area for the convenience' sake. The large contact area increases the friction resistance between the impeller 43 and the casing 12.

To tackle this problem, trenches 38*a*, 39*a* are formed in the first and second flange parts 38,39 of the impeller 43, respectively. The trenches 38*a*, 39*a* are recessed from and go around the circumferential surfaces of the first and second flange parts 38, 39, respectively. The trenches 38*a*, 39*a* reduces the contact area between the circumferential surfaces of the flange parts 38, 39 and the inner peripheral wall of the casing 12, thereby enabling avoidance of the above increase in friction resistance.

With the trenches 38*a*, 39*a* formed, the labyrinth effects can be obtained in the small spaces between the circumferential surfaces of the flange parts 38, 39 and the inner peripheral wall of the casing 12. As a result, reduction is contemplated in leakage from the high pressure side to the low pressure side through the small spaces, for example, leakage flow through a space between the second flange part 39 and the casing 12 toward the inlet 33 of the impeller.

As a result of the above, the centrifugal pump may be advantageous in improving its efficiency.

The shapes in section of the trenches 38*a*, 39*a* are not limited specifically, and may be any shapes. In view to obtaining the labyrinth effect, the trench may be formed only in the second flange part 39. Alternatively, it may be formed only in the first flange part 38. In this case, at least an effect of reducing the friction resistance can be obtained.

The trenches 38*a*, 39*a* may be formed in the impeller 41 as shown in FIG. 8 and the like. The arcs 42*a* of the impeller 42 as shown in FIG. 10 and the trenches 38*a*, 39*a* in the impeller 43 shown in FIG. 11 may be formed in combination.

Each of the impellers 11, 41, 42, 43 is installed in such a posture that the inlet 33 opens downward in the perpendicular direction, but the installation posture of each impeller is not limited by no means. For example, the impeller may be installed transversely so that the inlet faces transversely. The vertical direction in the above description is a direction for convenience' sake, and does not limit the actual installation direction.

What is claimed is:

1. An impeller, comprising:

an impeller body in which an internal channel is formed, the internal channel extending inside the impeller body in a direction of a rotation axis spirally about the rotation axis to connect an inlet open in an end surface of the impeller body and an outlet open in a circumferential surface thereof; and at least one centrifugal vane provided in the impeller body, wherein the internal channel is formed to have a closed cross-section with a predetermined inner diameter inside the impeller body, an upstream end of the internal channel forms the inlet of the impeller body, and a downstream end of the internal channel forms the outlet of the impeller body, the internal channel has a predetermined passage diameter, an external channel is formed so as to continue to the outlet of the impeller body and go around the circumferential surface of the impeller body about the rotation axis, the external channel being defined by the centrifugal vane and being recessed inward in the radial direction from the circumferential surface of the impeller body, and the external channel has a reduced portion in which the channel width in the direction of the rotation axis reduces gradually as it goes downstream in a flow direction.

2. The impeller of claim 1, wherein the channel width of the external channel reduces gradually in the entire section from an upstream end to a downstream end thereof.

3. The impeller of claim 1, wherein respective side parts in the direction of the rotation axis of the impeller body which interpose the external channel form flange parts protruding radially outward from the entire periphery thereof, and an edge part of at least one of the flange parts is cut to increase the channel width of the external channel in the direction of the rotation axis gently from inside toward outside in the radial direction.

4. The impeller of claim 1, wherein respective side parts in the direction of the rotation axis of the impeller body which interpose the external channel form flange parts with spaces left from an inner peripheral wall of a casing accommodating the impeller body in a pump, in at least one of the flange parts, a trench is formed so as to be recessed inward in the radial direction from and go around the circumferential surface of the at least one flange part.

* * * * *